United States Patent [19]

Clabburn et al.

[11] 4,415,217

[45] Nov. 15, 1983

[54] CABLE JOINING CONNECTOR AND METHOD

[75] Inventors: Robin J. T. Clabburn, Menlo Park; Rolf B. Stroessner, Palo Alto, both of Calif.

[73] Assignee: Raychem Corporation, Menlo Park, Calif.

[21] Appl. No.: 283,843

[22] Filed: Jul. 16, 1981

[51] Int. Cl.[3] ..... H01R 21/00

[52] U.S. Cl. ..... 339/113 L; 174/72 R; 339/157 R; 339/DIG. 1

[58] Field of Search ..... 174/71 R, 72 R; 339/113 L, DIG. 1, 154 R, 154 A, 159 C, 157 R

[56] References Cited

U.S. PATENT DOCUMENTS 540,540 6/1895 Croskey et al. ..... 174/72 R
3,851,296 11/1974 Muchmore et al. ..... 339/DIG. 1

FOREIGN PATENT DOCUMENTS 2041132 2/1972 Fed. Rep. of Germany ... 339/154 A
1571380 7/1980 United Kingdom .

*Primary Examiner*—Eugene F. Desmond
*Attorney, Agent, or Firm*—Gail-Deanna Salasny; James W. Peterson

[57] ABSTRACT

A re-enterable cable jointing connector for electrical power distribution network cables and the method of using the connector to isolate cables physically and chemically one from another, the connector having at least two current carrying elements, each having at least three connection portions to which the individual cable cores may be attached, and having an electrically insulating body. The insulating body substantially surrounds the current carrying elements and extends at least up to the connection portions, thereby electrically insulating the current carrying elements from one another and interfacially isolating the cables from one another. Cables which are size, configuration or material incompatible may be jointed. Power cables may be optionally provided with in-line joints, branch joints or service connections by means of this compact connector. Any number of branch or service connections may be provided by assembling cable jointing connectors in combination or by fabricating a connector with current carrying elements having many connection portions.

6 Claims, 4 Drawing Figures

CABLE JOINING CONNECTOR AND METHOD

BACKGROUND OF THE INVENTION

1. Field of the Invention

This invention relates to power cable jointing, and more particularly to a re-enterable cable jointing connector and a re-enterable cable connection and isolation method.

2. Description of the Prior Art

Electrical utility companies use two basic types of cable for low voltage (≦1,000 volts, ~1,000 amps) installations: single core and multicore. Single core cables are now all polymer insulated, using materials such as polyvinylchloride or cross-linked polyethylene. Multicore cables are either polymer or paper insulated and are, in the majority of cases, either four-core or three-core with surrounding neutral/ground wires. Paper insulated multicore cables are all metal sheathed and oil-filled; some draining, some non-draining. Polymer insulated multicore cables may be armored with steel wires or tapes. Most low voltage installations today are three phase plus neutral and/or ground. In the majority of cases, neutral and ground are now combined. Moreover, in the United States at least, reference to a single core cable is often synonymous with single phase.

Three basic types of low voltage joints are incorporated into the electrical network: in-line joints, branch joints and service connections. In-line joints are made when two cables are connected together or when a cable is repaired after failure. A branch joint (T-joint) is a second main cable jointed into the first main cable. Usually the cables involved in a branch joint are similar in size and have similar current carrying capabilities. The third type of joint, service connections, are taps into the distribution network for small consumers, such as, homes, small factories or street lighting. The number of service cables which can be connected to the main cable via a service joint can presently be as high as six, but four is more typical. It is desirable for service connections to be re-entered to add additional services or to break and remake existing connections.

The evolution of power distribution technology has made jointing of non-compatible cables a major problem for the electrical industry which now mixes cable types extensively within distribution networks. Paper insulated cables are damaged by water ingress, and hence joints and terminations in such cables must be waterproof. Paper insulated cables jointed directly to polymer insulated cables are therefore susceptible to damage, such as from water inadvertantly channeling through the interstices of a multicore polymer insulated cable. The insulation of low voltage polymer insulated cables are not susceptible to moisture and the majority of such cables are not water blocked, however, the insulation may be damaged by contact with oil, such as from oil-filled paper insulated cables. Polymer insulated cables jointed directly to oil-filled paper insulated cables are thus susceptible to deterioration from contact with the oil.

The first cables were paper insulated and easily damaged by moisture ingress. The first joints consisted of metal half-shells filled with an insulation medium such as oil or bitumen. When the first multicore plastic insulated cables were introduced, the same basic approaches as were used with paper insulated cables were used again, except that the details were modified slightly.

One such modification is the use of casting resin to replace bitumen and a simple vacuum-formed housing to replace the metal shell. As both types of cables became used on the same network, various compatibility problems resulted. One of the more widely used solutions to multicore cable jointing compatibility problems was the low voltage distribution pillar-pedestal, into which the cables were brought and interconnections made using a series of small bus bars, a miniature version of an indoor distribution board. Such a pedestal is typically ground mounted, about 30 inches high and 15 inches square and is often regarded by engineers as a poor alternative to underground jointing. The pedestal is not compact in size and is subject to problems such as condensation, flooding and vehicular damage.

Analogous approaches are used on single core cables. The most recent innovation in this area was a low voltage single phase multiple connector ("the octopus"), which is a small, insulated bus bar-type device which incorporates the ability for individual connection points to be accessed, a butt connection made and subsequently sealed without effecting other connections. Although compact, this device is limited to single phase use because it cannot be scaled up as a practical matter. Multicore cables are very rigid and their cores not easily bent. Three phase devices of this design would not be compact and would require four of five separate bus bars depending on whether neutral and ground were combined. The butt-style of connection would result in unacceptably long lengths of bare cores, which would pose an especial hazard if connections were made under tension. Cores of paper insulated cables would be especially susceptible to damage. Thus, no compact device exists which allows three phase and neutral joints to be made, sealed and subsequently re-entered without difficulty. No single compact device exists which allows jointing of size, configuration or material incompatible cables, especially those to be buried.

SUMMARY OF THE INVENTION

The purpose of the instant invention is to provide a compact, re-enterable cable jointing connector for low voltage electrical power distribution network cables and a method of using the connector to isolate cables physically and chemically one from another, while achieving in-line electrical connection as well as environmental sealing adequate for underground burial.

To accomplish this purpose a connector is provided which comprises at least two current carrying elements, each having at least three connection portions to which the individual cable cores may be attached, and an electrically insulating body. The insulating body substantially surrounds the current carrying elements and extends at least up to the connection portions, thereby electrically insulating the current carrying elements from one another and interfacially isolating the cables from one another. Electrical insulation and environmental sealing are preferably provided by adhesive-coated, heat-shrinkable polymeric components.

Cables which are size, configuration or material incompatible may be jointed. The connector is compact and is preferably round-compatible so as to match the configuration of the cables thereby enabling efficient utilization of space. Power cables may be optionally provided with in-line joints, branch joints or service connections by means of this compact connector. Any number of branch or service connections may be provided by assembling cable jointing connectors in combination or by fabricating a connector with current carrying elements having many connection portions.

An object of the instant invention is to provide a compact device which allows single phase and multiphase cables to be jointed and those jointed connections re-entered without difficulty, thereby rendering the system less expensive and relatively craft-insensitive.

Another object of this invention is to provide a device which allows cables which are size, configuration or material incompatible to be jointed.

Still another object of this invention is to provide for any number of branch or service connections to be made by assembling jointing devices in combination.

A further object of this invention is to provide a re-enterable connection and isolation method for electrically interconnecting, interfacially isolating, electrically insulating and environmentally sealing power cables.

DETAILED DESCRIPTION OF THE INVENTION

In one aspect, our invention provides a re-enterable cable jointing connector for electrical power distribution network cables having cores, comprising:

(a) at least two current carrying elements, each having at least three connection portions to which the individual cable cores may be attached, the connection portions of one current carrying element positioned adjacent to corresponding connections portions of other current carrying elements to define respective connector outlets, one for each cable to be connected; and (b) an electrically insulating body substantially surrounding the current carrying elements and extending at least up to the connection portions, the insulating body electrically insulating the current carrying elements from one another and interfacially isolating the cables to be attached from one another.

In another aspect, our invention provides a re-enterable connection and isolation method for jointing electrical power distribution network cables having an outer protective layer and cores, comprising the steps of:

(a) providing a cable jointing connector which comprises:

(i) at least two current carrying elements, having at least three connection portions to which the individual cable cores may be attached, the connection portions of one current carrying element positioned adjacent to corresponding connection portions of other current carrying elements to define respective connector outlets, one for each cable to be connected; and (ii) an electrically insulating body substantially surrounding the current carrying elements and extending at least up to the connection portions, the insulating body electrically insulating the current carrying elements from one another and interfacially isolating the cables to be attached from one another;

(b) removing a portion of the outer protective layer of each cable to be jointed to expose the cable cores;

(c) isolating each cable to be connected physically and chemically by positioning the cable jointing connector between the cables, said cable jointing connector acting as a barrier; and (d) attaching each exposed cable core to one connection portion to establish electrical contact.

In a further aspect, our invention provides that any number of branch or service connections may be provided by assembling cable jointing connectors in combination.

Figure 1:
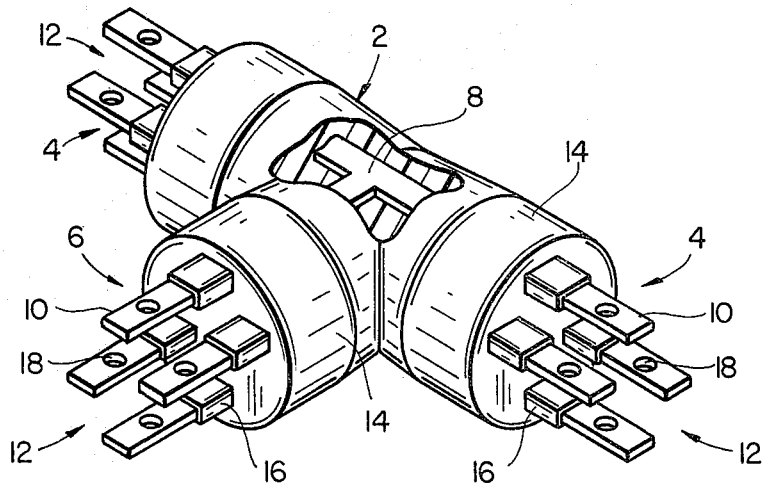
FIG. 1 illustrates in perspective view a re-enterable cable jointing connector according to this invention which has three male outlets and which has had a portion of the insulating body cut-away to better view the stacked and staggered current carrying elements within.

Referring to the drawing, FIG. 1 illustrates a re-enterable cable jointing connector 2 having two male main outlets 4 and one male branch outlet 6. The connector 2 has four current carryng elements 8 each having three connection portions 10.

Figure 2:
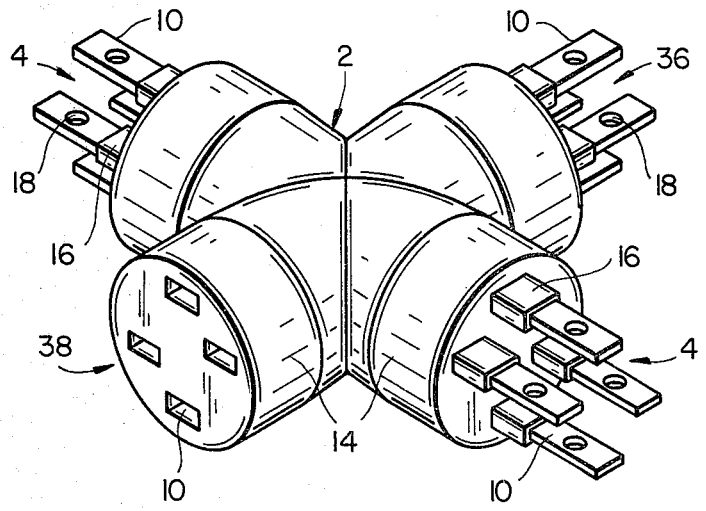
FIG. 2 illustrates in perspective view a re-enterable cable jointing connector according to this invention whih has four outlets: three male and one female.

An assembly of connection portions 10 together comprise a "connector outlet", shown generally at 12. Specifically, the connection portions 10 of one current carrying element 8 positioned adjacent to corresponding connections portions 10 of other current carrying elements 8, define respective connector outlets 12, one for each cable to be connected. An outlet 12 provides electrical connection capability for one cable. If a main cable is to be connected, the connector outlet is called a "main outlet", and may be further characterized as "male", if it protrudes, or as "female" if it surrounds. Thus, FIG. 1 illustrates two male main outlets 4. FIG. 1 further illustrates a male branch outlet 6. A "branch outlet" is an outlet to which a branch cable is to be connected. It may have a male or a female configuration, as may a "service outlet", which is an outlet to which a service cable is to be connected. A male service outlet 36 is shown in FIG. 2. Single core cables may be connected to multi-core cables, as well as single to single and multi- to multi-.

A "tandem outlet" is an outlet to which another outlet may be joined in tandem. FIG. 2 shows a female tandem outlet 38. Tandem joining may be directly accomplished male to male or male to female. Female to female tandem joining is possible but would require a male-male interconnection assembly (not shown). Moreover, female to female or male to female joining would require a joining harness (not shown), such as a strap, especially at high amperage levels. Any number of branch or service connections may be provided by assembling cable jointing connectors in combination by interconnecting tandem outlets, two or more of which are joined together at the connection portions of at least one connector outlet of each connector. Clearly, a branch or service outlet may be used as a tandem outlet when joined as stated above.

The current carrying elements are shown in a cutaway as having a planar T-shaped configuration. They may also have a Y-shaped configuration, and in any event, need not lie in one plane. These current carrying elements 8 are shown as bus bars which have been stamped-out of a suitable sheet metal, such as copper, for ease of fabrication, although other methods of fabrication are contemplated by this invention.

An electrically insulating body 14 is shown substantially surrounding the current carrying elements 8 and extending up to the connection portion 10. This insulating body electrically insulates the current carrying elements from one another and interfacially isolates the cables to be jointed from one another. The body 14 may be formed from any dielectric material, such as, for example, a cast or molded epoxy resin. FIG. 1 in particular illustrates the simplicity of design and construction of the connector in the engineered state.

Electrically insulation extension layers 16 are also shown in FIG. 1. These extend from the insulating body 14 and surround at least a portion of each connection portion. The extension layers 16 may be formed (i) by dip-coating the current carrying elements 8 in part or in their entirity, after they have been formed, (ii) by utilizing polymeric sleeves (as shown in FIG. 1) positioned over and around current carrying elements 8 so that they extend from the insulating body 14, (iii) by extending the insulating body 14 itself, or (iiii) by overlappingly wrapping an insulating tape around the elements 8.

When the extension layers 16 are polymeric sleeves, they may be heat-shrinkable. Heat-shrinkable polymeric sleeves are preferred, especically adhesive-coated heat-shrinkable polymeric sleeves. FIG. 1 shows extension layers 16 in the form of heat-shrunk sleeves in place, i.e. after positioning, the sleeves were heated to cause shrinking into circumferential contact. The extension layers 16 may be phase color-coded according to the international color-coding convention, to identify corresponding connections portions of respective connector outlets and to thereby facilitate connection of these phase cables. Dip-coated connection portions 10 may be ring cut in the field to expose at least a small electrially conductive portion of the current carrying elements 8, such as, at least the holes 18 in the connection portions 10.

Cable may comprise several protective layers, such as an outer polymeric sheath, an armored sheath and an insulating layer or layers, herein referred to collectively as "an outer protective layer". Current is carried by conductive cores contained within the outer protective layer. These conductive cores may be independently insulated. For the purposes of this invention, use of the word "core" refers to any element within the cable which is able to carry electric current and hence encompasses solid metal conductors, a bundle of metal wires forming a conductor, or metallic wires, braided sleeves or meshes, which serve as neutral or ground leads, carrying power back to the generator or to ground respectively.

Figure 4:
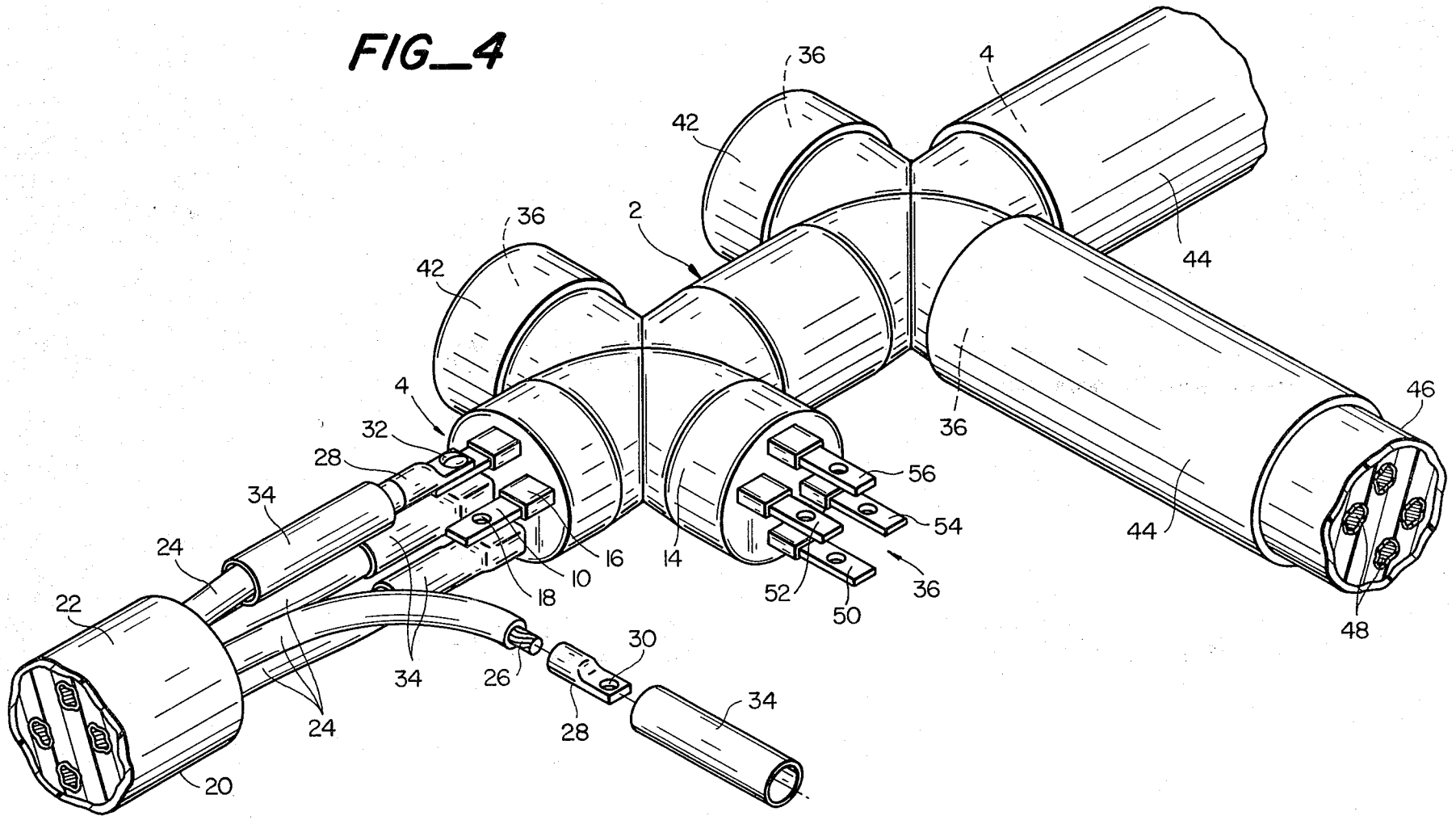
FIG. 4 illustrates in perspective view a re-enterable cable jointing connector according to this invention which has six male outlets. The cable cores of a cable are shown in partial expanded view as being connected to connection portions of a male main outlet and insulated by individual connection insulators. Two of the service outlets are shown as capped. One service outlet and one main outlet are shown with cables already connected and overall insulators in place.

Cables which are to be jointed are prepared by first removing a portion of the outer protective layer to expose the cable cores. If the cable cores are independently insulated, a portion of this insulation is removed also. This is illustrated in FIG. 4, where the main cable 20 has had its outer protective sheath 22 removed to expose the individually insulated cores 24 within. The exposed core 26 is shown in FIG. 4 as being fitted with a crimp lug 28, the crimp lug 28 having a hole 30 which may be matched to a hole 18 formed in each connection portion 10 for the purpose of connection. A bolt 32 or the like is inserted through the overlappingly matched holes 30 and 18 to secure the connection, although other methods of securing the connection are contemplated.

FIG. 4 also shows individual connection insulators 34 which are depicted as preferred heat-shrinkable sleeves, although they could comprise another sleevetype or tape, and which are assembled by sliding the individual connection insulator 34 over the exposed core 26 up onto the insulated core 24 before the crimp lug 28 is joined. The individual connection insulator 34 may then be repositioned after connection of the crimp lug 28 to the connection portions 10 thereby enclosing the connection portion 10, overlapping the individual insulated cable core 24 at one extremity and extending substantially up to the insulating body 14 at the other extremity. Where insulating extension layers 16 are present, as shown in FIG. 4, the individual connection insulators 34 are repositioned around one connection portion 10 to enclose the connection portion 10, overlapping the individual insulated cable core 24 at one extremity and overlapping the extension layer 16 at the other extremity. Where, as here in FIG. 4, the individual connection insulators 34 are polymeric sleeves, they may be heat-shrinkable polymeric sleeves, in which case, heat is applied to shrink the sleeve into circumferential contact once it has been repositioned as indicated. The sleeve may be adhesive-coated and when the adhesive is a hot-melt adhesive, the application of heat serves also to cause the adhesive to flow and to form an integral seal as it cools.

FIG. 2 illustrates a re-enterable cable jointing connector 2 having two male main outlets 4, one male service outlet 36 and one female tandem outlet 38. The female tandem outlet 38 is for the purpose of interconnecting re-enterable cable jointing connectors 2 to form connectors having many service outlets, such as by joining a male tandem outlet 40 (shown in FIG. 3) to the female. A female tandem outlet 38 is formed by extending the insulating body 14 over the connection portions 10 on one side of the insulating body 14 so as to substantially surround the connection portions 10 on that side. The structure of the connection portions 10 are in this instance of a type which surrounds, for example, the cable core to be connected, as opposed to being of the type which protrudes. The current carrying elements 8 in FIG. 2 have a crossed-configuration in one plane, but they may also have an X- or an H-shaped configuration and in any event, need not lie in one plane.

Figure 3:
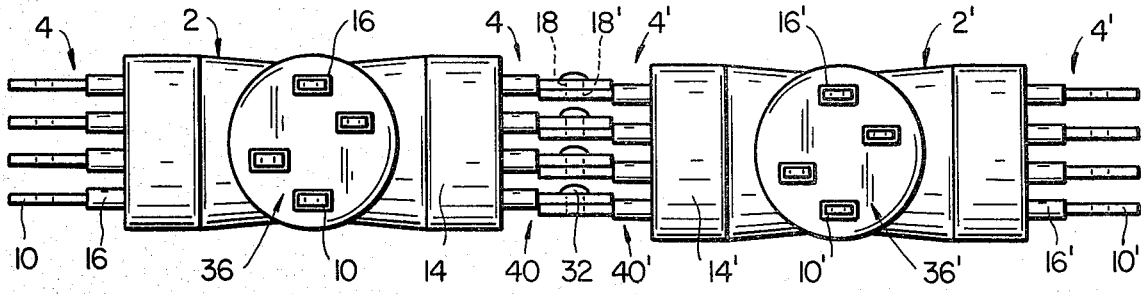
FIG. 3 is a plan view of two re-enterable cable jointing connectors according to this invention which each have four male outlets and which have been joined in tandem.

FIG. 3 illustrates two re-enterable cable jointing connectors 2 and 2' according to this invention, each having four male outlets: two main outlets 4, 4 and 4', 4', one main outlet of each serving simultaneously as a male tandem outlet 40 and 40', and two service outlets 36, 36 and 36', 36'. The male tandem outlets 40 and 40', are joined by overlapping the holes 18 and 18' of their respective connection portions 10 and 10' and inserting a bolt 32 through them to secure the connection. Any number of re-enterable cable jointing connectors 2 may be connected in tandem in this manner, although bolting is given as one example only among several possible methods of securing the interconnections. Thus, tandem connections, male to female, and tandem connections, male to male (shown in FIG. 3) are possible. Moreover, more than two connectors may be joined in combination.

An alternate example of a method of securing the connection of the respective connection portions 10 and 10', which are shown as rectangular bus bars, but which could be circular, or other, is described in U.K. Patent No. 1,571,380 to Robin J. T. Clabburn et al, herein incorporated by reference. A heat-recoverable metal member is positioned about a socket member, which socket member may be attached to a conductor such as the connection portions 10 of the current carrying elements 8. The recovery of the metal member deforms a deformable portion of the socket to secure the connection.

The joined connection portions 10 and 10' of FIG. 3 may be insulated by providing a plurality of interconnection insulators, one for each pair of interconnected connection portions, each interconnection insulator being electrically insulating and being positioned around a respective pair of interconnected connection portions to enclose the interconnection, overlapping each connection portion of the respective pair. These insulators may be heat-shrinkable polymeric sleeves, in which case installation includes the step of heating to cause shrinking into circumferential contact. The sleeves may be adhesive-coated and when the adhesive is a hot-melt adhesive, the application of heat serves also to cause the adhesive to flow and to form an integral seal as it cools.

The joined connection portions of FIG. 3 may be environmentally sealed (not shown) by providing an overall interconnection insulator, which is electrically insulating and which is positioned over and around the pair of interconnected connectors to enclose the interconnection, overlapping each insulating body of said pair of interconnected connectors. If several connectors are joined in combination, one overall insulator is provided for each pair joined. These insulators preferably are heat-shrinkable polymeric sleeves, in which case installation includes the step of heating to cause shrinking into circumferential contact. Preferably the sleeves are adhesive-coated. When the adhesive is a hot-melt adhesive, the application of heat to cause shrinking of the sleeve, serves also to cause the adhesive to flow and to form an integral seal as it cools.

FIG. 4 illustrates a re-enterable cable jointing connector 2 which is fabricated to have six male outlets: two main outlets 4 and four service outlets 36. As previously discussed, the cable cores of a cable are shown in partial expanded view as being connected to connection portions 10 of a male main outlet 4, one cable core being connected to one connection portion 10. Two of the male service outlets 36 are shown as capped by caps 42 which are preferably fabricated of heat-shrinkable polymeric materials and which are preferably lined with an adhesive. After positioning the cap so as to enclose one connector outlet, thereby insulating and sealing the connector outlet, where the cap is heat-shrinkable, heat is applied to cause it to shrink into circumferential contact. Service outlet 36 and main outlet 4 are both shown with cables already connected and overall insulators 44 in place, respectfully.

The overall insulators 44 are shown in FIG. 4 as heat-shrinkable polymeric sleeves which have been circumferentially positioned and shrunk by the application of heat into circumferential contact. Each overall insulator 44 is electrically insulating and is positioned over and around a connected cable 46 to enclose the connected cable cores 48 and to extend transversely on either side thereof, over-lapping the insulated cable at one extremity and overlapping the insulating body at the connector outlets at the other extremity. Thus, a cable may be isolated physically and chemically by attaching the cores of said cable to connection portions 10 on one side of the molded body 14 so that said molded body 14 acts as a barrier.

Not necessary for the practice of this invention, but of possible advantage is the additional physical and chemical isolation provided by pre-treating and pre-sealing the cables, especially multi-core cables by means of, for example, cable break-out sleeves (not shown). These seal the truncated cables and especially the crotch areas between individual cable cores, while allowing cable cores to be broken-out individually from the cable for connection purposes. Cable break-out sleeves, if used, are preferably of heat-shrinkable polymeric materials. They serve to retain oil within paper insulated cables and to prevent water, which may inadvertently enter and channel down the interstices of polymer insulated cables, from entering the connection outlet areas of the cable jointing connectors of this invention.

FIG. 4 shows the connector as having six outlets formed by stacking and staggering the four current carrying elements 10 which are bus bars. For discussion purposes, the bus bars at one outlet 36 have been numbered 50, 52, 54 and 56.

With continuing reference to FIG. 4, bus bars 50 and 56 are identical stampings which are symmetrical about a long portion having a long axis, i.e. having six legs of equal length. Bus bars 52 and 54 are identical stampings which are asymmetrical about a long portion having a long axis, i.e. having two legs on one side and one leg on one end of the long portion which are shorter than the other three legs. This allows for a very compact stacking and staggering arrangement which provides that the outlet be round-compatible with cables and the space be used efficiently.

Bus bars 50 and 56 are spacially stacked one above the other. Bus bars 52 and 54 are first stacked in alignment with one another and then one is rotated 180° with respect to the other in the same plane in which they lie. Next, bus bar 52 is interposed above bus bar 50 such that its long portion lies parallel to the long portion of bus bar 50, but its short-legged side is staggered to the left of bus bar 50. Then, bus bar 54 is interposed above bus bar 52 such that its long portion lies parallel to the long portion of bus bar 50, but its short-legged side is staggered to the right of bus bar 50.

An alternate method of stacking and staggering four current carrying elements in order to result in a spacially-efficient, round-compatible configuration, consists of stamping four identical bus bars (not shown) all of which are asymmetrical about a long portion having a long axis, i.e. having 2 legs on one side and one leg on one end of the long portion which are shorter than the others, such as bus bars 52 and 54 in the previous example. These may then be alternately stacked and rotated and may be called 52, 54 and 52', 54' (not shown).

The stacking arrangement is that initially all four bus bars are stacked and aligned together. Then, 52 and 52' are pulled out and stacked one with respect to the other, 52' being stacked above 52. Next, 54 and 54' are rotated 180° in the plane in which they lie. They are then interposed between 52 and 52' as follows: 54' is staggered to the left of 52 and interposed spacially above 52, while 54 is staggered to the right of 52 and inserted spacially above 54 but below 52', in every case, aligning in parallel the long portions of each.

The preferred embodiments of this invention have been illustrated and described, but changes and modifications can be made, and some features can be used in different combinations without departing from the invention as defined in the claims.

What is claimed is:

1. A re-enterable cable jointing connector for electrical power distribution network cables having cores, comprising:

(a) at least two current carrying elements, each having at least three connection portions to which the individual cable cores may be attached, the connection portions of one current carrying element positioned adjacent to corresponding connection portions of other current carrying elements to define respective connector outlets, one for each cable to be connected;

(b) an electrically insulating body substantially surrounding the current carrying elements and extending at least up to the connection portions, the insulating body electrically insulating the current carrying elements from one another and interfacially isolating the cables to be attached from one another; and (c) a plurality of electrically insulating extension layers, one for each connection portion, each layer extending from the insulating body and surrounding at least a portion of each connection portion.

2. A re-enterable cable jointing connector, comprising two or more of the connectors according to claim 1, joined together at the connection portions of at least one connector outlet of each connector, to provide additional outlets to which cables may be connected and which further comprises:

(a) a plurality of interconnection insulators, one for each pair of interconnected connection portions, each interconnection insulator being electrically insulating and being positioned around a respective pair of interconnected connection portions to enclose the interconnection, overlapping each connection portion of said respective pair; and (b) which further comprises at least one overall interconnection insulator, one for each pair of interconnected connectors, each overall insulator being electrically insulating and being positioned over and around a respective pair of interconnected connectors to enclose the interconnection, overlapping each insulating body of said respective pair of interconnected connectors.

3. A connector according to claim 1, which further comprises a plurality of connection insulators, one for each connection portion, each connection insulator being electrically insulating and being positioned around a respective connection portion to enclose the connection portion, overlapping the individual cable core to be connected at one extremity and extending substantially up to the insulating body at the other extremity of said connection insulator.

4. A connector according to claim 1, in which the electrically insulating extension layers are phase color-coded to identify corresponding connection portions of respective connector outlets.

5. A re-enterable connection and isolation method for jointing electrical power distribution network cables having an outer protective layer and cores, comprising the steps of:

(a) providing two or more cable jointing connectors, each cable jointing connector comprising:

(i) at least two current carrying elements, having at least three connection portions to which the individual cable cores may be attached, the connection portions of one current carrying element positioned adjacent to corresponding connection portions of other current carrying elements to define respective connector outlets, one for each cable to be connected; and (ii) an electrically insulating body substantially surrounding the current carrying elements and extending at least up to the connection portions, the insulating body electrically insulating the current carrying elements from one another and interfacially isolating the cables to be attached from one another;

(b) removing a portion of the outer protective layer of each cable to be jointed to expose the cable cores;

(c) positioning the cable jointing connector between the cables, isolating each cable to be connected physically and chemically, said cable jointing connector acting as a barrier;

(d) attaching each exposed cable core at one connection portion to establish electrical contact;

(e) interconnecting two or more cable jointing connectors by joining together the connection portions of at least one connector outlet of each connector, to provide additional outlets to which cables may be connected; and (f) environmentally sealing the interconnection by providing at least one overall inerconnection insulator, one for each pair of interconnected connectors, each overall insulator being electrically insulating and being positioned over and around a respective pair of interconnected connectors to enclose the interconnection, overlapping each insulating body of said respective pair of interconnected connectors.

6. A connection and isolation method according to claim 5, wherein the interconnection insulators and the at least one overall interconnection insulator are all heat-shrinkable polymeric sleeves, being circumferentially positioned around each respective pair of interconnected connection portions and each respective pair of interconnected connectors, respectively, and which further comprises the step of heating the insulators after positioning to cause shrinking of the sleeves into circumferential contact.

* * * * *